US006338551B1

(12) United States Patent
Sugiura et al.

(10) Patent No.: US 6,338,551 B1
(45) Date of Patent: Jan. 15, 2002

(54) INK CHAMBER AND PIEZOELECTRIC ACTUATOR STRUCTURE IN AN INK JET PRINTER HEAD, AND INK JET PRINTER INCORPORATING SAME

(75) Inventors: Toshiaki Sugiura; Seiichi Kanemoto; Masatomo Kojima, all of Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/094,568

(22) Filed: Jun. 15, 1998

(30) Foreign Application Priority Data

Jun. 19, 1997 (JP) ..... 9-162972

(51) Int. Cl.[7] ..... B41J 2/045
(52) U.S. Cl. ..... 347/71; 347/70; 347/88
(58) Field of Search ..... 347/70–72, 88

(56) References Cited

U.S. PATENT DOCUMENTS 5,612,725 A * 3/1997 Okimoto ..... 347/71
5,617,127 A * 4/1997 Takeuchi et al. ..... 347/71
5,670,999 A * 9/1997 Takeuchi et al. ..... 347/70
5,755,909 A * 5/1998 Gailus ..... 156/229
5,983,471 A * 11/1999 Osawa ..... 347/70 X

FOREIGN PATENT DOCUMENTS

JP 9-57964 * 3/1997
JP 9-141847 6/1997
JP 9-141848 6/1997

* cited by examiner

*Primary Examiner*—Benjamin R. Fuller
*Assistant Examiner*—C Dickens
(74) *Attorney, Agent, or Firm*—Oliff & Berridge, PLC

(57) ABSTRACT

An ink jet printer head of hot-melt type for heating and melting solid ink and then discharging the melted ink onto a recording medium is provided with: a cavity plate prescribing (i) an ink flow path through which the melted ink is supplied, (ii) a plurality of ink storing chambers, each of which is connected to the ink flow path in which the supplied ink is temporarily stored, and (iii) a plurality of ink discharge holes which are connected to respective one of the ink storing chambers though which the temporarily stored ink is discharged; a piezoelectric element member, which is opposed to the cavity plate and has a plurality of piezoelectric elements for selectively changing capacities of the ink storing chambers; and a base member for supporting the piezoelectric element member. The piezoelectric element member is interposed and fixed between the cavity plate and the base member. The cavity plate, the piezoelectric element member and the base member have thermal expansion coefficients equal or approximate to each other.

16 Claims, 4 Drawing Sheets

INK CHAMBER AND PIEZOELECTRIC ACTUATOR STRUCTURE IN AN INK JET PRINTER HEAD, AND INK JET PRINTER INCORPORATING SAME

BACKGROUND OF THE INVENTION

1. Field of the Invention

The present invention relates to an ink jet printer head and an ink jet printer having the ink jet printer head.

2. Description of the Related Art

There is an actuator of a head equipped in an ink jet printer, which expands and restores the capacity of many ink storing chambers formed inside the actuator using a piezoelectric element installed corresponding to each of the ink storing chambers, and which applies pressure to the ink inside the ink storing chamber. In this way, the actuator discharges the ink from an ink discharge hole formed in each of the ink storing chambers to the external i.e., onto the recording sheet.

As one example of such an actuator, this is an actuator provided with: a base plate; a piezoelectric element member fixed on the base plate; a cavity plate, which is fixed on the piezoelectric element member and in which the ink storing chambers and ink flow paths to supply the ink to the ink storing chambers are formed.

The cavity plate is made from polyethersulfon etc., while the base plate is made from alumina etc., so that a displacement due to the piezoelectric effect by the piezoelectric element is efficiently reflected to the ink discharge.

However, in an ink jet printer of a so-called hot-melt type, in which a solid ink is heated and melted to be discharged, the temperature of the actuator portion becomes equal to or higher than about 120° C. Thus, since the difference in the thermal expansion coefficient between the cavity plate and the piezoelectric element is relatively large, a positional shift or drift is generated between the position of the ink storing chamber and the piezoelectric element, resulting in that it is difficult to perform an efficient ink discharge, which is a problem.

Further, in the above mentioned actuator, 128 ink discharge holes are formed, for example, and the same number of the ink storing chambers and the piezoelectric elements respectively are prepared.

In such a construction, in case of expanding the ink storing chambers by actuating just one or a small number of the piezoelectric elements, the cavity plate made from the aforementioned material exhibits an enough rigidity or stiffness. However, in case of expanding all or a large number of the ink storing chambers by actuating all or a large number of the 128 piezoelectric elements, the rigidity of the cavity plate is not enough and the cavity plate is deformed. This result in that the difference between the capacities of the respective ink storing chambers are generated, so that it is not possible to perform a uniform ink discharge, which is another problem.

SUMMARY OF THE INVENTION

Given these circumstances, it is an object of the present invention to provide: an ink jet printer head of hot-melt type, which can perform an efficient ink discharge even if it is heated up to a relatively high temperature, and which can perform a uniform ink discharge even if a large number of piezoelectric elements thereof are simultaneously actuated; and an ink jet printer having such an ink jet printer head.

The above object of the present invention can be achieved by an ink jet printer head of hot-melt type for heating and melting solid ink and then discharging the melted ink onto a recording medium. The ink jet printer head is provided with: a cavity plate prescribing (i) an ink flow path through which the melted ink is supplied, (ii) a plurality of ink storing chambers, each of which is connected to the ink flow path in which the supplied ink is temporarily stored, and (iii) a plurality of ink discharge holes which are connected to respective one of the ink storing chambers though which the temporarily stored ink is discharged; a piezoelectric element member, which is opposed to the cavity plate and has a plurality of piezoelectric elements for selectively changing capacities of the ink storing chambers; and a base member for supporting the piezoelectric element member. The piezoelectric element member is interposed and fixed between the cavity plate and the base member. The cavity plate, the piezoelectric element member and the base member have thermal expansion coefficients equal or approximate to each other.

According to the ink jet printer head of the present invention, when the peripheral circumference of the ink flow path is heated-up in order to heat and melt the solid ink, the base member, the piezoelectric element member and the cavity plate are also heated-up, so that each of these constitutional elements are thermally expanded. At this time, since these constitutional elements have the thermal expansion coefficients equal or approximate to each other, these constitutional elements are thermally expanded in degrees same or similar to each other. This results in that the positional shift or drift between the position of the piezoelectric element and the position of the ink storing chamber corresponding to each other can be restrained depending on the degree of the approximation.

In one aspect of the ink jet printer head of the present invention, the cavity plate and the base member are made from ceramic, and elastic coefficients and thicknesses of the cavity plate and the base member are set so that a flexure amount thereof in a direction of discharging the ink be smaller than that of the piezoelectric element member.

According to this aspect, in case that the capacity of the ink storing chamber is changed by the piezoelectric effect of the piezoelectric element and that the internal pressure within the ink storing chamber is increased, the deformation of the cavity plate can be restrained, so that the variation in the capacities between the ink storing chambers are not practically generated. Further, although the force of the piezoelectric element applied to change the form of the cavity plate is also applied to the side of the base member, since the predetermined elastic coefficient and thickness are set for the base plate, this force of the piezoelectric element can be applied as a force applied to the side of the cavity plate. Thus, it is possible to change the capacity of the ink storing chamber enough to appropriately discharge the stored ink.

In another aspect of the ink jet printer head of the present invention, the ink jet printer head is further provided with a partition plate interposed and fixed between the cavity plate and the piezoelectric element member. The partition plate has a thermal expansion coefficient equal or approximate to that of respective one of the cavity plate, the piezoelectric element member and the base member.

According to this aspect, the displacement of the piezoelectric element is transmitted through the partition plate to the ink storing chamber. At this time, since the partition plate has the thermal expansion coefficient equal or approximate to that of respective one of the cavity plate, the piezoelectric element member and the base member, even if the peripheral circumference of the ink flow path including these constitutional elements is heated up, the displacement of the partition plate is still appropriate, so that the displacement of the piezoelectric element can be transmitted surely to the ink storing chamber.

In this aspect, the partition plate may comprise a diaphragm having elasticity. Thus, the ink storing chamber, which shape is once change by the displacement of the piezoelectric element, can be restored by the elasticity of the diaphragm.

In another aspect of the ink jet printer head of the present invention, the ink jet printer head is further provided with a nozzle plate, which is disposed on a surface of the cavity plate on a side of discharging the ink and in which a plurality of nozzle holes connected to respective one of the ink discharge holes are formed. The nozzle plate has a thermal expansion coefficient equal or approximate to that of respective one of the cavity plate, the piezoelectric element member and the base member.

According to this aspect, when the peripheral circumference of the ink flow path is heated up, the nozzle plate is also heated-up, and the force due to the increase of the internal pressure of the ink storing chamber is also applied to the nozzle plate. However, since the nozzle plate has a thermal expansion coefficient equal or approximate to that of respective one of the cavity plate, the piezoelectric element member and the base member, the degree of the expansion due to the applied heat and the deformation due to the application of the aforementioned force can be appropriately restrained. Thus, it is possible to appropriately discharge the ink.

In another aspect of the ink jet printer head of the present invention, the cavity plate and the base comprise same material.

According to this aspect, the thermal expansion coefficient as well as the elastic coefficient can be made same to each other between the cavity plate and the base member since they comprise the same material.

In this aspect, the same material may be alumina. In this case, cavity plate and the base plate can function appropriately to discharge the ink even if they are in the high temperature condition.

In another aspect of the ink jet printer head of the present invention, the piezoelectric element member comprises lead zirconate titanate.

According to this aspect, the thermal expansion coefficient as well as the elastic coefficient of the piezoelectric element member are appropriate to discharge the ink by the displacement of the piezoelectric element member.

The above object of the present invention can be also achieved by an ink jet printer provided with the above described ink jet printer head of the present invention or any one of the above described various aspects thereof, and a moving device for relatively moving the ink jet printer head with respect to the recording medium.

According to the ink jet printer of the present invention, since it is provided with the above described ink jet printer head of the present invention, the constitutional elements of the ink jet printer head are thermally expanded in degrees same or similar to each other. This results in that the positional shift or drift between the position of the piezoelectric element and the position of the ink storing chamber corresponding to each other in the ink jet printer head can be restrained depending on the degree of the approximation, so that it is possible to improve a printing quality.

The nature, utility, and further features of this invention will be more clearly apparent from the following detailed description with respect to preferred embodiments of the invention when read in conjunction with the accompanying drawings briefly described below.

DETAILED DESCRIPTION OF THE PREFERRED EMBODIMENT

A preferred embodiment for the present invention is explained with reference to the drawings.

Figure 1:
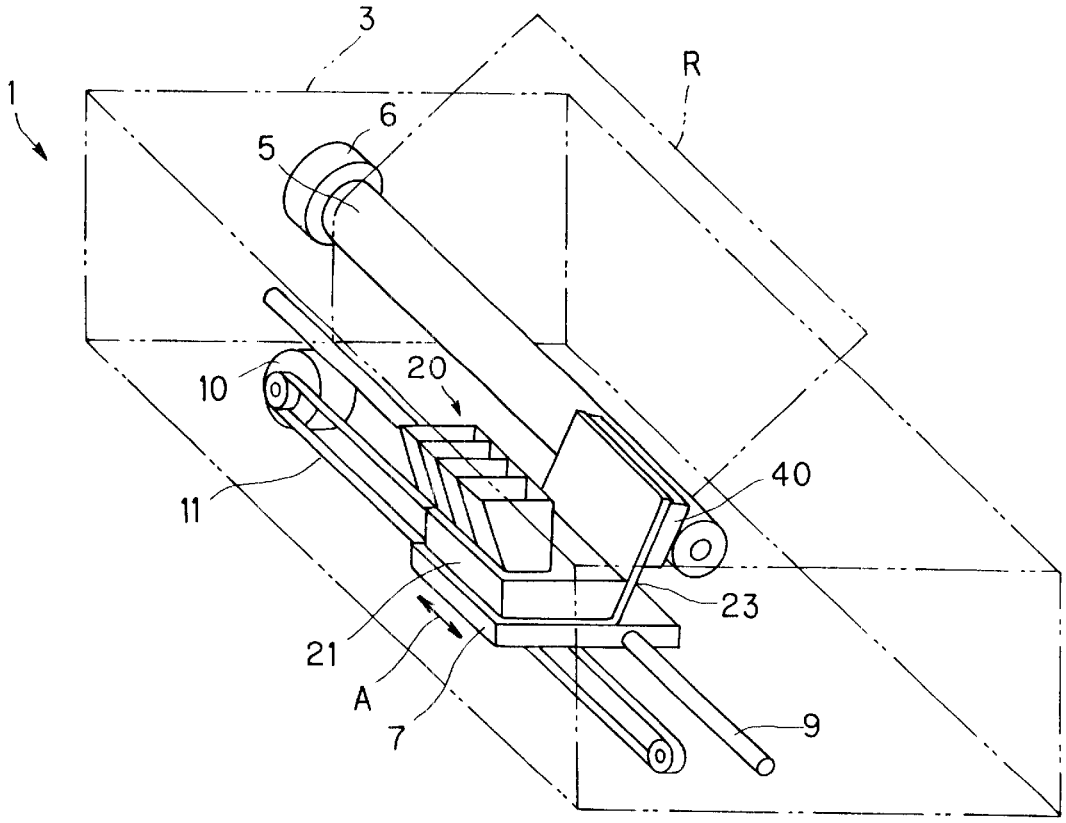
FIG. 1 is a perspective view showing the internal of an ink jet printer 1 according to an embodiment of the present invention.

FIG. 1 is a perspective view showing the internal of an ink jet printer (hereafter, this may be also called simply as a printer) 1 according to an embodiment of the present invention.

In FIG. 1, the printer 1 is provided with a transport roller 5, which is driven by a transport motor 6, for transporting a recording paper R, as one example of a recording medium to be recorded with, toward an upper side of the printer 1 in a frame body 3 thereof. A head 20 supported by a carriage 7 is installed in the transport path of the recording paper R. Moreover, a supporting member 9 that is fixed on the frame body 3 supports the carriage 7 movably in the back and forth directions indicated by an arrow A orthogonal to the transport direction of the recording paper R. In addition, a timing belt 11 which the carriage motor 10 drives fixes the carriage 7, enabling the carriage 7 to move freely the back and forth directions indicated by the arrow A.

The head 20 is provided with: ink tanks 21 for storing inks of four colors (i.e., yellow, magenta, cyan, and black); ink discharging actuators 40 for discharging the inks of four colors; and a front panel 23 for transporting the ink from the respective ink tanks 21 to the corresponding actuators 40.

Figure 2:
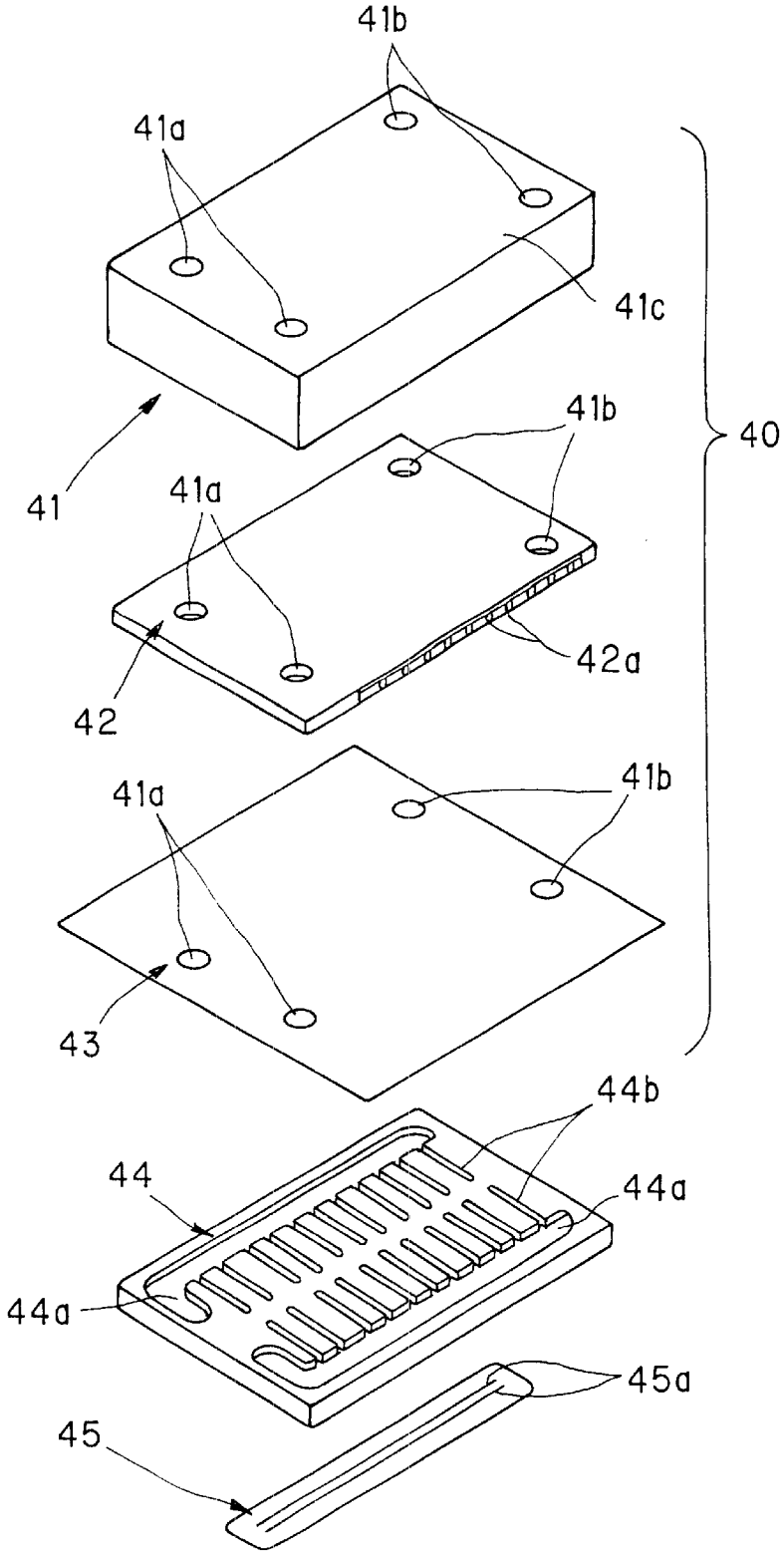
FIG. 2 is a perspective separation view showing an actuator 40 of the printer 1 according to the embodiment of the present invention.

As shown in FIG. 2, each of the actuators 40 is provided with a base 41, a piezoelectric element member 42, and a diaphragm 43.

The base 41 supports each of the above-described components of the actuator 40.

Figure 3:
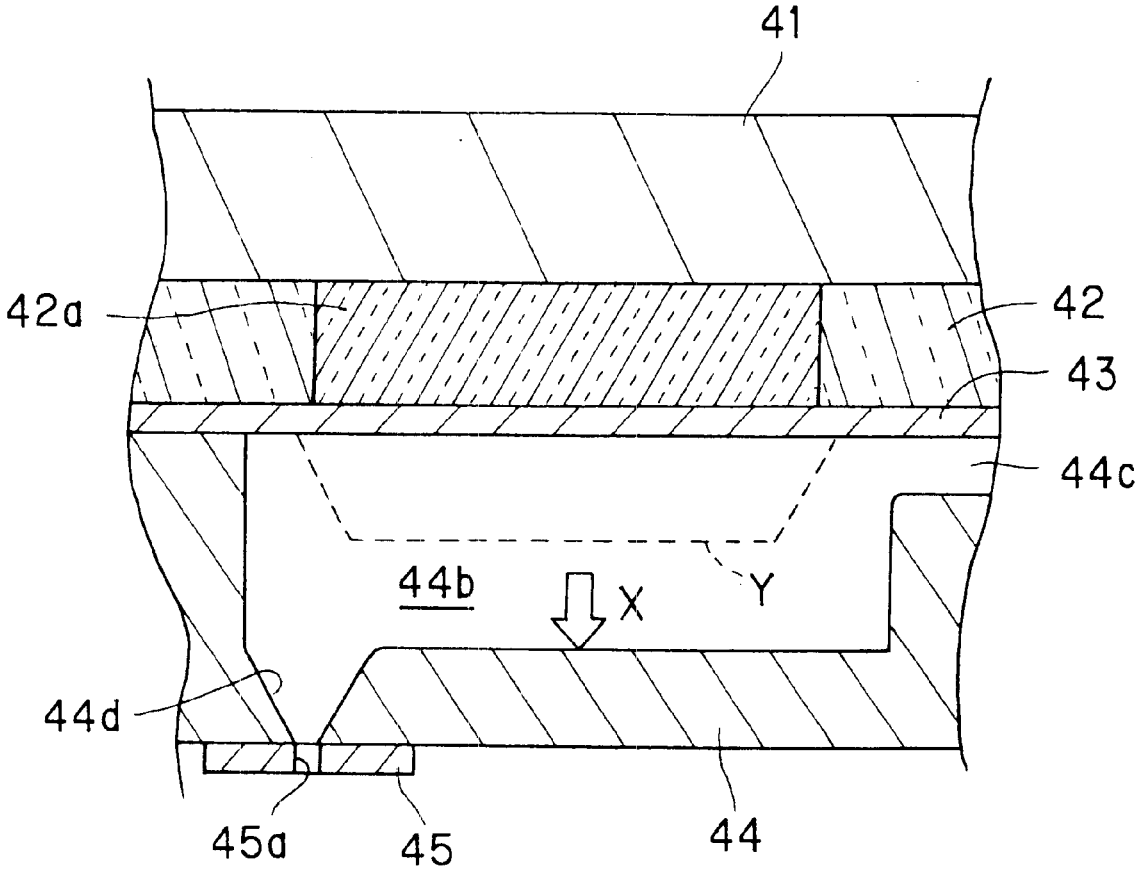
FIG. 3 is a vertical cross sectional view showing a vertical cross section of the actuator 40 of the printer 1 according to the embodiment of the present invention.

The piezoelectric element member 42 is provided with a large number (e.g., 128) of piezoelectric elements 42*a*, so as to expand and shrink individually each of the ink storing chambers 44*b* of the cavity plate 44. When the driving voltage is applied to respective one of the piezoelectric elements 42*a*, the piezoelectric element 42*a* expands in the direction indicated by an arrow X, so as to shrink the capacity of the ink storing chamber 44*b* as indicated by a broken line Y, as shown in FIG. 3 which is a vertical cross sectional view of the actuator 40. When the driving voltage is released, the piezoelectric element 42*a* restores or returns to its original initial state by the elasticity of the diaphragm 43.

The diaphragm 43 separates the piezoelectric element member 42 from the cavity plate 44, and has elasticity.

The cavity plate 44 has two L-shaped ink flow paths 44*a*, and ink storing chambers 44*b* that branch out perpendicularly from the ink flow paths 44*a*. The number of the ink storing chambers 44*b* is equal to the number of the ink discharge holes 45*a*. Each of the ink storing chambers 44*b* is connected to the respective one of the ink discharge holes 45*a*. Further, as shown in FIG. 3, each of the ink storing chambers 44*b* formed on the cavity plate 44 is connected to respective one of the ink flow paths 44*a* via a connecting path 44*c*. An orifice 44d for leading to the respective ink discharge hole 45*a* is formed at the bottom of the ink storing chamber 44*b*.

The nozzle plate 45 is a flat plate on which a large number of (e.g., 128) ink discharge holes 45*a* are arranged in two rows respectively.

Incidentally, two forward paths 41*a* and two backward paths 41*b* for circulating the ink from the ink tank 21 in FIG. 1 through the ink flow paths 44*a* penetrate through the base 41, the piezoelectric element member 42, and the diaphragm 43.

Next, an operation of discharging the ink from the actuator 40 of the head 20, that is constructed in the above-described manner, will be explained with reference to FIG. 1 to FIG. 3.

The ink is compressed and fed from the ink tank 21 (shown in FIG. 1) to the pair of the ink flow paths 44*a* passing through the pair of forward paths 41*a*, and fills the ink flow path 44*a* (shown in FIG. 2). By releasing the driving voltage, the original state of the piezoelectric element 42*a* is restored. The ink is then guided through the ink flow path 44*a* and the connecting path 44*c*, to be thereby drawn into the ink storing chamber 44*b*. Thus, the ink storing chamber 44*b* is filled with the ink.

Then, by applying the driving voltage to the piezoelectric element 42*a* so as to shrink the capacity of the ink storing chamber 44*b*, the ink is guided through the orifice 44d to the ink discharge hole 45*a*, and is discharged outside of the ink storing chamber 44*b*.

By this ink discharge operation of the actuator 40, the ink is discharged from the actuator 40 onto the recording paper R.

Therefore, the ink in the orifice 44d is discharged accurately through the nozzle hole 45*a* having a fine diameter formed in the nozzle plate 45.

Here, it is to be noted that, in the ink jet printer of hot-melt type for heating and melting the solid ink and then discharging the melted ink, the actuator 40 is also heated up so that the temperature thereof is raised to be equal to or higher than about 120° C. Thus, the piezoelectric element member 42 is expanded by the heat, and the positional shift or drift is caused between the position of the piezoelectric element 42*a* and the position of the ink storing chamber 44*b* corresponding to each other. This results in that the displacement of the piezoelectric element 42*a* cannot be efficiently reflected to the ink discharge.

Figure 4A:
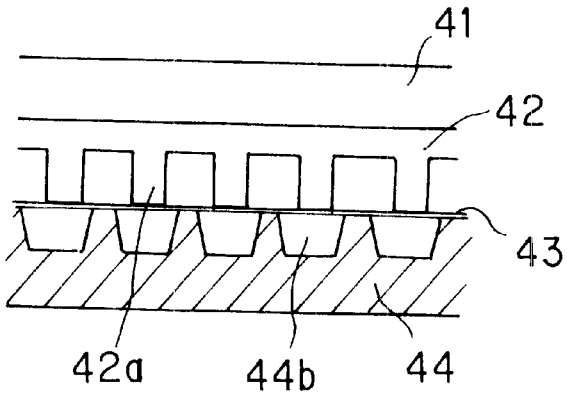
FIG. 4A is a schematic diagram showing a condition of a cavity plate and a base before actuating piezoelectric elements.
Figure 4B:
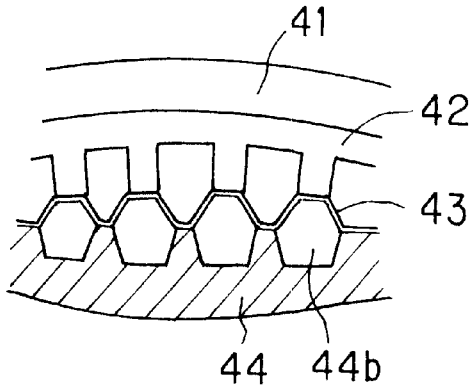
FIG. 4B is a schematic diagram showing a condition of the cavity plate and the base when actuating the piezoelectric elements.

On the other, in case that all of the 128 piezoelectric elements 42*a* are displaced in the direction to expand the ink storing chambers 44*b* respectively, a large force is applied to the cavity plate 44, so that the longitudinal central portion of the cavity plate 44 may be deformed to protrude as shown in FIG. 4A (showing the condition before actuating piezoelectric elements 42*a*) and FIG. 4B (showing the condition when actuating the piezoelectric elements 42*a*).

When such a deformation is generated, the difference in the pressure between the ink storing chambers 44*b* is generated, resulting in that it is difficult or practically impossible to obtain a uniform discharge property at each ink discharging hole 45*a*.

In contrast to this, in the present embodiment, as a countermeasure for the positional shift or drift due to the above explained thermal expansion, the actuator 40 is constructed such that the material for the cavity plate 44, the material for the piezoelectric element member 42 and the material for the base 41 have the thermal expansion coefficients approximate to each other, so that these constitutional elements of the actuator 40 expand in the degrees approximate to each other even if the actuator 40 is heated up.

Further, in the present embodiment, the nozzle plate 45 and the diaphragm 43 are also made from the materials having the thermal expansion coefficients approximate to those of the above mentioned constitutional elements of the actuator 40.

As concrete examples in the present embodiment, the nozzle plate 45 is made from zirconia, which thermal expansion coefficient is about $9.5\times10^{-6}$. The cavity plate 44 and the base 41 are made from alumina, which thermal expansion coefficient is about $7.5\times10^{-6}$. The diaphragm 43 is made from aramid film, which thermal expansion coefficient is about $2.0\times10^{-6}$. The thermal expansion coefficient of the piezoelectric element member 42 is about $2.0\times10^{-6}$. Especially, each difference in the thermal expansion coefficient between the cavity plate 44, the base 41 and the piezoelectric element member 42 respectively is preferably not greater than $10\times10^{-6}$ by the reason described later in detail with the concrete example and the mathematical analysis thereof.

In this manner, since the thermal expansion coefficients are approximate to each other between these constitutional elements of the actuator 40, even in case that the actuator 40 is heated and the temperature thereof is raised to be equal to or higher than about 120° C., the degrees of the expansions of these constitutional elements are approximate to each other. Thus, it is possible to restrain the positional shift or drift between the position of the piezoelectric element 42*a* and the position of the ink storing chamber 44*b* corresponding to each other.

Next, in the present embodiment, the change of the internal pressure in the ink storing chamber 44*b*, with respect to the displacement of the piezoelectric element 42*a*, is coped with by setting the elastic coefficients of the cavity plate 44 and the base 41 to predetermined values.

In the vertical cross section along the longitudinal direction of the cavity plate 44, assuming that the cross sectional area of the ink storing chamber 44*b* is A, the length of the ink storing chamber 44*b* along the width direction (i.e., the direction perpendicular to the longitudinal direction) of the cavity plate 44 is 1, the volumetric elastic coefficient of the cavity plate 44 is Ev, the increase amount of an internal pressure p within the ink storing chamber 44*b* is expressed by a following expression (1), and is proportional to the increase amount of the cross sectional area of the ink storing chamber 44*b*.

$$dp/dt=-EV/A\cdot dA/dt \quad (1)$$

wherein A : cross sectional area of the cavity

Ev: volumetric elastic coefficient

Then, the increase amount of the cross sectional area in case that just one piezoelectric element 42*a* is actuated can be calculated by the difference between the shrinkage amount that the piezoelectric element 42*a* shrinks the capacity of the ink storing chamber 44*b* and the expansion amount that the piezoelectric element 42*a* expands the capacity of the ink storing chamber 44*b*.

Further, the increase amount of the cross sectional area, in case that the 64 piezoelectric elements 42*a* on the half side are simultaneously actuated among the 128 piezoelectric elements 42*a*, can be also calculated by the difference between the shrinkage amount that the piezoelectric element 42*a* shrinks the capacity of the ink storing chamber 44*b* and the expansion amount that the piezoelectric element 42*a* expands the capacity of the ink storing chamber 44*b*. However, in this case, since the deformation of the cavity plate 44 is not caused when the capacity is shrunk, there is no difference in the shrinkage amount between the case where just one piezoelectric element 42*a* is actuated and the case where the 64 piezoelectric elements 42*a* on the half side are simultaneously actuated.

Figure 4C:
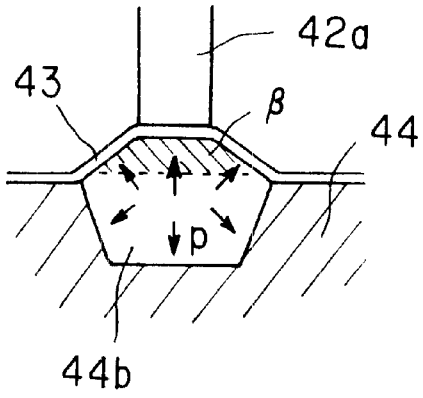
FIG. 4C is a schematic diagram explaining an increase of a capacity and an internal pressure of an ink storing chamber when actuating the piezoelectric element.

Therefore, assuming that the shrinkage amount of the cross sectional area of the ink storing chamber 44*b* due to the deformation of the piezoelectric elements 42*a* is $\alpha$, the increase amount of the cross sectional area due to the increase of the internal pressure in case that just one piezoelectric element 42*a* is actuated as shown in FIG. 4C is $\beta$, and the increase amount of the cross sectional area due to the increase of the internal pressure in case that the 64 piezoelectric elements 42*a* on the half side are simultaneously actuated is $\beta'$, the ratio of the changes in the effective cross sectional areas between the case where just one piezoelectric element 42*a* is actuated and the case where the 64 piezoelectric elements 42*a* on the half side are simultaneously actuated can be expressed by a following expression (2).

$$\phi=(\alpha-\beta')/(\alpha-\beta) \quad (2)$$

Then, by making this ratio of the changes in the effective cross sectional areas approximate to 1, it is possible to reduce the change of the internal pressure in the ink storing chamber 44*b* between the case where just one piezoelectric element 42*a* is actuated and the case where the 64 piezoelectric elements 42*a* on the half side are simultaneously actuated.

Therefore, the ratio of the changes in the effective cross sectional areas when the elastic coefficient of the cavity plate 44 is changed to 10000, 20000 and 30000 [kgf/mm$^2$] is examined. The result as shown in a following TABLE 1 is obtained.

TABLE 1

| cavity elastic coefficient (kgf/mm$^2$) | ratio of the changes in effective cross sectional areas $\phi$ |
|---|---|
| 10000 | 0.56 |
| 20000 | 0.75 |
| 30000 | 0.86 |

For example, when the elastic coefficient of the cavity plate 44 is 30000 [kgf/mm$^2$], the internal pressure in each ink storing chamber 44*b* is 5 [atm], the shrinkage amount of the cross sectional area $\alpha$ is $17.2\times10^{-6}$ [mm$^2$], the increase amount of the cross sectional area $\beta$ is $1.1\times10^{-6}$ [mm$^2$], and the increase amount of the cross sectional area $\beta'$ is $3.4\times10^{-6}$ [mm$^2$], so that the ratio of the changes in the effective cross sectional areas becomes 0.86.

Therefore, in the present embodiment, in order to set this ratio of the changes in the effective cross sectional areas exceeds 0.86, the cavity plate 44 is made from alumina, the elastic coefficient thereof is set to about 35000 [kgf/mm$^2$] and the thickness thereof is set to about 2.5 mm. Further, the same material is used for the base 41 and the same elastic coefficient is given to the base 41, and that the thickness of the base 41 is set to about 4 to 4.5 mm.

The reason why the same elastic coefficient is given to the base 41 is to transmit the displacement of the piezoelectric element 42*a* efficiently to the ink discharge by restraining the escape of the displacement to the side of the base 41 which is caused by improving the rigidity of the cavity plate 44.

In contrast to this, the piezoelectric element member 42 has the thickness of about 1 mm and the elastic coefficient of about 5000 [kgf/mm$^2$], so that the rigidities of the cavity plate 44 and the base 41 are set to be much greater than that of the piezoelectric element 42*a*.

Therefore, even in case that all of the piezoelectric elements 42*a* are simultaneously actuated, it is possible to restrain the deformation of the cavity plate 44 in an extremely little degree, it is possible to prevent the difference in the capacities between the ink storing chambers 44*b* from being generated, and it is possible to maintain the uniform ink discharge ability.

In the present embodiment, the elastic coefficient of the nozzle plate 45 is set to 22000 [kgf/mm$^2$] by use of zirconia as a material thereof. By this, it is possible to more surely prevent the deformation of the ink discharging portion of the actuator 40.

Further, in the present embodiment, the diaphragm 43 is made from aramid film having the thickness of about 16 $\mu$m, and the elastic coefficient thereof is set to about 1500 [kgf/mm$^2$]. The reason why they are set in this manner is that, if the diaphragm 43 is too elastic or soft, the displacement of the piezoelectric element 42*a* is absorbed by the diaphragm 43. Thus, according to the present embodiment, the displacement of the piezoelectric element 42*a* is not absorbed by the diaphragm 43, but can be transmitted to the ink storing chamber 44*b* certainly.

The elastic coefficients, the thermal expansion coefficient and so on of the respective constitutional elements of the actuator 40 in the present embodiment are indicated in TABLE 2 as following.

TABLE 2

| ELEMENT NAME | MATERIAL NAME | THICKNESS | ELASTIC COEFFICIENT (kgf/mm$^2$) | THERMAL EXPANSION COEFFICIENT ($\times10^{-6}$) |
|---|---|---|---|---|
| NOZZLE PLATE | ZIRCONIA | 40 $\mu$m | 22000 | 9.5 |
| CAVITY PLATE | ALUMINA | 2.5 mm | 35000 | 7.5 |
| DIAPHRAGM | ARAMID | 16 $\mu$m | 1500 | 2 |
| PIEZOELECTRIC ELEMENT MEMBER | LEAD ZIRCONATE TITANATE | 1 mm | 5000 | 2 |
| BASE | ALUMINA | 4 TO 4.5 mm | 35000 | 7.5 |

The respective values of the thickness, the elastic coefficient etc., in the above TABLE 2 are the examples, and the present invention is not limited to these values. As for the value of the rigidity, the higher value is the more preferable. As for the values of the thermal expansion coefficients, the values more approximate to each other are the more preferable.

Assuming that each thermal expansion coefficient of the cavity plate 44 and the base 41 is $\alpha_1$, the thermal expansion coefficient of the piezoelectric element member 42 is $\alpha_2$, the elastic coefficient of the piezoelectric element member 42 is $E_2$ and the temperature at the time of adhering or bonding these three elements is T, a stress σ applied to the piezoelectric element member 42 at a temperature θ is expressed by a following expression (3).

$$\sigma=-E_2\times(\alpha_2-\alpha_1)\times(\theta-T) \quad (3)$$

The product of the elastic coefficient and the transversal cross sectional area of the cavity plate 44 and the base 41 is assumed to be much greater than that of the piezoelectric element member 42. If this value of the stress σ exceeds a certain tolerable stress of the piezoelectric element member 42, a crack may be generated. As this tolerable stress here, there may be employed a tolerable stress obtained by dividing the value of the transversal strength, which is obtained by a transverse test such as a three points bending test or the like, by an appropriate safety factor.

Assuming that T=130° C. and θ=0° C., from the values indicated in Table 2, the stress σ at this temperature θ (=0° C.) can be calculated by use of the above expression (3) as following.

$$\sigma=-5000\times(2-7.5)\div1000000\times(0-130)=-3.6\ [\mathrm{kgf/mm^2}]$$

This calculated value of the stress σ is much less than a general value of the transversal strength of the piezoelectric element member e.g. 8to 13 [kgf/mm$^2$]. Therefore, there is practically no possibility that the crack is generated or the destruction occurs due to the stress by the temperature difference. If each difference in the thermal expansion coefficient between the cavity plate 44, the base 41 and the piezoelectric element member 42 respectively exceeds $10\times10^{-6}$, the absolute value of the stress σ expressed by the above expression (3) becomes about 6.5 [kgf/mm$^2$], so that the safety factor of greater than 1.5 cannot be expected.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. An ink jet printer head comprising:

a cavity plate prescribing (i) an ink flow path through which ink is supplied, (ii) a plurality of ink storing chambers, each of which is connected to the ink flow path in which the supplied ink is temporarily stored, and (iii) a plurality of ink discharge holes which are connected to respective ones of the ink storing chambers through which the temporarily stored ink is discharged;

a piezoelectric element member, which is opposed to said cavity plate and has a plurality of piezoelectric elements for selectively changing capacities of the ink storing chambers; and a base member for supporting said piezoelectric element member, said piezoelectric element member being interposed and fixed between said cavity plate and said base member, said cavity plate, said piezoelectric element member and said base member having thermal expansion coefficients equal or approximate to each other, said cavity plate and said base member each having an elastic coefficient and a thickness so that a flexure amount of said cavity plate and said base member in a direction of a displacement of said piezoelectric element for discharging the ink is smaller than a flexural amount of said piezoelectric element member.

2. An ink jet printer head according to claim 1, wherein said cavity plate and said base member are made from ceramic, and elastic coefficients and thicknesses of said cavity plate and said base member are set so that a flexure amount thereof in a direction of discharging the ink be smaller than that of said piezoelectric element member.

3. An ink jet printer head according to claim 1, further comprising a partition plate interposed and fixed between said cavity plate and said piezoelectric element member, said partition plate having a thermal expansion coefficient equal or approximate to that of respective one of said cavity plate, said piezoelectric element member and said base member.

4. An ink jet printer head according to claim 3, wherein said partition plate comprises a diaphragm having elasticity.

5. An ink jet printer head according to claim 1, further comprising a nozzle plate, which is disposed on a surface of said cavity plate on a side of discharging the ink and in which a plurality of nozzle holes connected to respective one of the ink discharge holes are formed, said nozzle plate having a thermal expansion coefficient equal or approximate to that of respective one of said cavity plate, said piezoelectric element member and said base member.

6. An ink jet printer head according to claim 1, wherein said cavity plate and said base comprise same material.

7. An ink jet printer head according to claim 6, wherein the same material is alumina.

8. An ink jet printer head according to claim 1, wherein said piezoelectric element member comprises lead zirconate titanate.

9. An inkjet printer comprising:

an ink jet printer head, and a moving device for relatively moving said ink jet printer head with respect to the recording medium, said ink jet printer head comprising:

a cavity plate prescribing (i) an ink flow path through which ink is supplied, (ii) a plurality of ink storing chambers, each of which is connected to the ink flow path in which the supplied ink is temporarily stored, and (iii) a plurality of ink discharge holes which are connected to respective ones of the ink storing chambers through which the temporarily stored ink is discharged;

a piezoelectric element member, which is opposed to said cavity plate and has a plurality of piezoelectric elements for selectively changing capacities of the ink storing chambers; and a base member for supporting said piezoelectric element member, said piezoelectric element member being interposed and fixed between said cavity plate and said base member, said cavity plate, said piezoelectric element member and said base member having thermal expansion coefficients equal or approximate to each other, said cavity plate and said base member each having an elastic coefficient and a thickness so that a flexure amount of said cavity plate and said base member in a direction of a displacement of said piezoelectric element for discharging the ink is smaller than a flexural amount of said piezoelectric element member.

10. An ink jet printer according to claim 9, wherein said cavity plate and said base member are made from ceramic, and elastic coefficients and thicknesses of said cavity plate and said base member are set so that a flexure amount thereof in a direction of discharging the ink be smaller than that of said piezoelectric element member.

11. An ink jet printer according to claim 9, wherein said ink jet printer head further comprises a partition plate interposed and fixed between said cavity plate and said piezoelectric element member, said partition plate having a thermal expansion coefficient equal or approximate to that of respective one of said cavity plate, said piezoelectric element member and said base member.

12. An ink jet printer according to claim 11, wherein said partition plate comprises a diaphragm having elasticity.

13. An ink jet printer according to claim 9, wherein said ink jet printer head further comprises a nozzle plate, which is disposed on a surface of said cavity plate on a side of discharging the ink and in which a plurality of nozzle holes connected to respective one of the ink discharge holes are formed, said nozzle plate having a thermal expansion coefficient equal or approximate to that of respective one of said cavity plate, said piezoelectric element member and said base member.

14. An ink jet printer according to claim 9, wherein said cavity plate and said base comprise same material.

15. An ink jet printer according to claim 14, wherein the same material is alumina.

16. An ink jet printer according to claim 9, wherein said piezoelectric element member comprises lead zirconate titanate.

* * * * *